US005336972A

United States Patent [19]

Sheffield et al.

[11] Patent Number: 5,336,972

[45] Date of Patent: Aug. 9, 1994

[54] HIGH BRIGHTNESS ELECTRON ACCELERATOR

[75] Inventors: Richard L. Sheffield; Bruce E. Carlsten; Lloyd M. Young, all of Los Alamos

[73] Assignee: The United States of America as represented by the United States Department of Energy, Washington, D.C.

[21] Appl. No.: 914,327

[22] Filed: Jul. 17, 1992

[51] Int. Cl.[5] ..... H05H 9/00

[52] U.S. Cl. ..... 315/5.41; 328/233

[58] Field of Search ..... 315/5.41, 5.42; 372/2; 313/359.1, 360.1; 328/227, 233, 64

[56] References Cited

U.S. PATENT DOCUMENTS

| | | | |
|---|---|---|---|
| 3,906,300 | 9/1975 | Tran | 315/5.42 |
| 4,155,027 | 5/1979 | Schriber et al. | 315/5.41 |
| 4,703,228 | 10/1987 | West | 315/5.41 X |
| 4,988,919 | 1/1991 | Tanabe et al. | 315/5.41 |
| 5,049,753 | 9/1991 | Flesner | 328/233 X |

OTHER PUBLICATIONS

Richard L. Sheffield et al., "Compact Free-Electron Laser at the Los Alamos National Laboratory," presented at SPIE's 1991 International Symposium on Optical and Optoelectronic Applied Science and Engineering, Jul. 21-26, 1991.

Richard L. Sheffield et al., "Physics Design of the High Brightness LINAC for the Advanced Free-Electron Laser Initiative at Los Alamos," presented at the Thirteenth International Free-Electron Laser Conference, Aug. 25-30, 1991.

*Primary Examiner*—Benny T. Lee

*Attorney, Agent, or Firm*—Ray G. Wilson; William A. Eklund; William R. Moser

[57] ABSTRACT

A compact high brightness linear accelerator is provided for use, e.g., in a free electron laser. The accelerator has a first plurality of acclerating cavities having end walls with four coupling slots for accelerating electrons to high velocities in the absence of quadrupole fields. A second plurality of cavities receives the high velocity electrons for further acceleration, where each of the second cavities has end walls with two coupling slots for acceleration in the absence of dipole fields. The accelerator also includes a first cavity with an extended length to provide for phase matching the electron beam along the accelerating cavities. A solenoid is provided about the photocathode that emits the electons, where the solenoid is configured to provide a substantially uniform magnetic field over the photocathode surface to minimize emittance of the electons as the electrons enter the first cavity.

7 Claims, 4 Drawing Sheets

HIGH BRIGHTNESS ELECTRON ACCELERATOR

BACKGROUND OF INVENTION

This invention relates to linear accelerators and, more particularly, to electron beam accelerators for use in free electron lasers. This invention is the result of a contract with the Department of Energy (Contract No. W-7405-ENG-36).

Electron beam accelerators for use in electron beam collider devices or in free electron lasers (FEL) require electron source accelerators capable of delivering pulse trains of electron bunches of high charge density. A high electron density implies a high peak current (100 A to 2000 A) and a low normalized transverse beam emittance, for example, $<30\ \pi\cdot$mm·mrad. A figure of merit for an electron beam is the "brightness" $B_n$ of the beam:

$$B_n=2I/\epsilon_x\epsilon_y A/(m^2\cdot rad^2),$$

where I is the peak current and $\epsilon_x$ and $\epsilon_y$ are the normalized transverse emittances of the beam. A normalized emittance is defined to be $$\epsilon_n=\beta\gamma\epsilon=4\pi\beta\gamma[<x^2><x'^2>-<x\cdot x'>^2]^{\frac{1}{2}},$$

where the brackets $<>$ denote an ensemble average over the electron beam, $\gamma$ is the relativistic factor, $\beta$ is the particle velocity divided by the speed of light, x is a transverse beam size, x' is a transverse beam divergence, and $\epsilon$ is the unnormalized emittance, where $\epsilon=\epsilon_x=\epsilon_y$ for an azimuthally symmetric beam.

One advance in electron accelerators producing an electron beam of high peak current, short burst duration, and high beam quality was the replacement of a conventional thermal electron emitter with an optically pulsed photocathode. The photocathode source is described in U.S. Pat. No. 4,715,038, "Optically Pulsed Electron Accelerator," issued Dec. 22, 1987.

It can be seen from the above discussion that the electron beam emittance must be maintained at a low value in order to increase the brightness of the beam at a given current. Many factors influence the beam emittance. For example, space charge effects adjacent the photocathode increase the emittance. Quadrupole fields along the accelerator are produced by conventional accelerating cavities and forces from the quadrupole fields tend to increase beam emittance.

However, new generations of FEL's are required for industrial, medical, and research applications, where the FEL is compact in size. Reducing the size of a FEL requires a concomitant reduction in size of the electron beam accelerator with a corresponding increase in accelerating field gradients and an aggravation of many factors that tend to increase beam emittance.

Accordingly, it is an object of the present invention to provide a compact linear accelerator for electrons and a high accelerating field gradient.

Another object of the present invention is maintain a low beam emittance at the high beam currents available from a photocathode electron source in order to maintain a high brightness beam.

One other object of the present invention is to eliminate quadrupole fields in at least the portion of the electron beam most affected by quadrupole fields.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a linear accelerator for electrons emitted from a photocathode source. A first plurality of accelerating cavities is arranged in series to receive electrons emitted from the source. Each one of the first plurality of cavities has end walls with four coupling slots for accelerating the electrons in the absence of quadrupole fields. A second plurality of accelerating cavities is also arranged in series to receive electrons from the first plurality of cavities. Each one of the second plurality of cavities has end walls with two coupling slots to accelerate the electrons in the absence of dipole fields. The selected arrangement of accelerating cavities enables a high accelerating field gradient to be maintained while maintaining a low beam emittance and concomitant high brightness.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
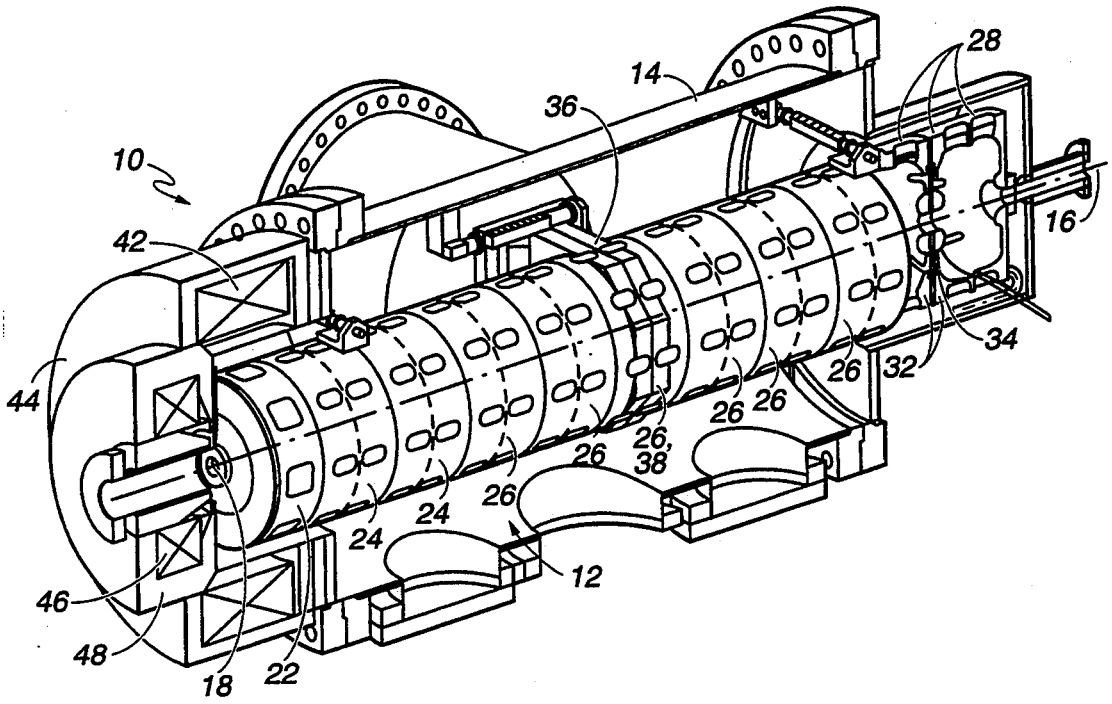
FIG. 1 is an isometric illustration in partial cross-section of a linear electron accelerator according to one embodiment of the present invention.

Referring first to FIG. 1, there is shown an isometric illustration, in partial cross-section, of one embodiment of a linear accelerator 10 according to the present invention. As herein discussed, it is contemplated that accelerator 10 will be suitable for use in a FEL, but the principles can be applied to any accelerator for accelerating an electron beam. Accelerating cavities 12 are arranged and supported within vacuum chamber 14 and define an axis 16 for propagation of an electron beam and possible injection of a laser to cause electron emission from photocathode 18. As shown in FIG. 1, accelerator 10 is comprised of a first half cavity 22 adjacent to and receiving electrons from photocathode 18, a first plurality of cavities with four coupling slots 24, and a second plurality of cavities with two coupling slots 26 for accelerating the electrons substantially in the absence of dipole fields. Thus, accelerator 10 is illustrated to be an on-axis-coupled structure that operates at the $\pi/2$ mode, i.e., each cavity is 90° out of phase with adjacent cavities, with ten (10) full accelerating cavities 24, 26 and one half accelerating cavity 22. Accelerator 10 is preferably designed to operate at room temperature, e.g, about 90° F., and at liquid-nitrogen temperature. At the lower operating temperature, reduced power losses in the structure will allow higher macropulse currents, e.g, 500 mA vs. 280 mA for a 20 MeV beam. It will be understood that accelerating cavities 12 are supported within vacuum vessel 14 in a manner that does not produce transverse displacements over the operating temperature range, although rotational movements are acceptable.

Solenoid 42 is provided about photocathode 18 to provide an axial magnetic field to focus electrons emitted from photocathode 18 along axis 16. The axial field preferably extends along the first two accelerating cavities 24. A ferromagnetic housing 44 is provided about solenoid 42 to better shape the axial field. Bucking solenoid 46 is conventionally provided adjacent photocathode 18 to reduce the axial magnetic field to zero along the face of photocathode (18). In accordance with the present invention solenoid 46 and housing 48 also provide a longitudinal magnetic field over the face of photocathode 18 that is uniform and substantially zero for reduced emittance of electrons arising from photocathode 18.

As shown in FIG. 1, each accelerating cavity may be formed from two half cavities, such as half cavities 28 for accelerating cavities 26. Each half cavity 28 defines an end wall 32 for abutting an adjacent end wall 32 and defining coupling cavity 34 therebetween. Accelerator 10 also includes a radio frequency (rf) feed wave guide 36 to input the rf power through iris section 38. Iris section 38 is a conventional accelerating cavity that provides an on-axis coupling of the rf energy along the accelerating cavities. Adjacent accelerating cavities are electrically connected through coupling cavities 34 and slots (see, e.g., slots 56 in FIG. 2) in half cavities 28, as hereinafter explained. The use of a single rf feed to drive the entire accelerator structure simplifies the overall accelerator design.

Figure 2:
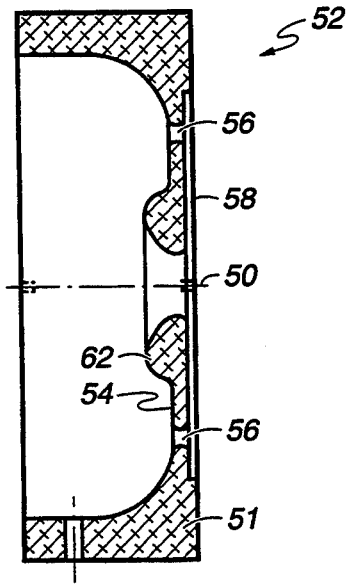
FIG. 2 is a cross-sectional view of half of an electron beam accelerating cavity according to one embodiment of the present invention.

FIG. 2 more particularly depicts half cavity 52 defined by housing 51 that is generally symmetric about electron beam axis 50. Housing 51 includes end wall 54 for facing toward the interior of the accelerating cavity formed by housing 51 and further defines half coupling cavity 58 to form a complete coupling cavity, e.g., cavity 34 (FIG. 1), in accelerator 10 assembly when abutted with an adjacent housing. End wall 54 defines coupling slots 56, which may be two slots or four slots, as discussed below, to minimize beam emittance. End wall 54 also defines entrance 62 for the electron beam to traverse housing 52 along beam axis 50.

Entrance 62 preferably includes rounded entrance edges to optimize the linearity of the electric field for accelerating the electron beam. By linear electric field is meant an electric field that varies directly as the radius. Prior art accelerators generally had relatively poor beam quality and the primary concern was to reduce losses in the accelerating cavities. Rounded entrances and linear fields act to lower the cavity shunt resistance and thereby increase power losses and were not used. In the present invention, beam quality is the primary concern with high accelerating rf field gradients, e.g., >20 MeV/m and a rounded shape is selected. The exact contour of the entrance is optimized using conventional accelerator design codes, e.g., SUPERFISH, and is somewhat different between the four slot cavities 24 and two slot cavities 26.

The configuration of coupling slots 56 in end wall 51 produces a significant effect for very high-brightness beams. For example, a single slot produces a dipole lens and concomitant beam deflection, a weaker quadrupole lens, weaker yet octupole lens, and so on. Two slots cannot produce a dipole, but do produce a quadrupole lens and weaker octupole lens. Four slots cannot produce a dipole or quadrupole lens, but produce a weak octupole that is too weak to produce an effect on the beam. Each accelerator cavity 24, 26 has coupling slots in each half housing. The relative orientation of the slots on either end of the cavity determine the relative angle of the corresponding lens.

A two coupling-slot configuration gives a quadrupole lens at the entrance and exit of an accelerator cavity. The orientation of the slots determine whether the quadrupole lens add or subtract focusing for each cell. For example, in a two coupling-slot configuration, the slots at the two end walls of an accelerating cavity may be either aligned (called a type-T configuration) or rotated 90° (called a type-H configuration). In a type-H configuration the fields at each cell end are additive, giving a net quadrupole lens. Further, the quadrupole lens effects add from cell-to-cell. In a type-T arrangement the fields at each cell end cancel, giving a net quadrupole effect close to zero. The loss effects also cancel from cell-to-cell. In both type-H and type-T configurations, the slots in abutting end walls forming a coupling cavity are rotated 90° relative to one another.

As noted above, it is desirable to minimize quadrupole fields in order to minimize emittance of the electron beam. The cancellation of the quadrupole effects in a type-T configuration is nearly zero, however, only for a highly relativistic beam. In the first few accelerating cavities, where the beam is not yet highly relativistic, a net quadrupole lens still exists. In accordance with the present invention, a four-coupling-slot arrangement is used in the first few cells. The four-slot arrangement has no quadrupole components, so the first few cells then produce no beam asymmetry.

Figure 3:
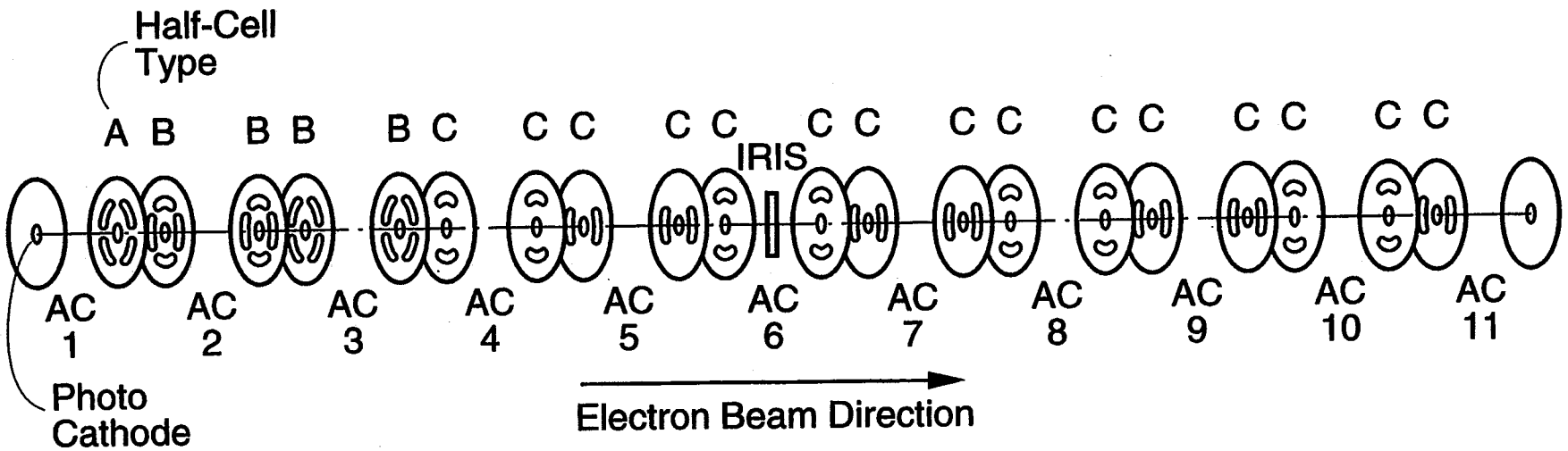
FIG. 3 schematically illustrates the accelerating cavity end wall arrangement of a type of accelerator, such as shown in FIG. 1.

FIG. 3 depicts a coupling slot arrangement for one embodiment of a high gradient electron beam accelerator. Electrons are emitted from the photo cathode and accelerated by a magnetic field produced by injected rf energy in accelerating cavities AC1–AC5 along the axial electron beam direction, pass through AC6, which includes the iris where radio frequency energy is input, and further accelerated by magnetic fields in accelerating cavities AC7–AC11 for output along the beam direction. The first half cavity, AC1, and the first two full cavities, AC2 and AC3 have a four slot configuration denoted as half-cell types A and B, respectively. The remaining cavities, AC4–AC11, have a two slot configuration, denoted as half-cell type C. Thus, the accelerator design shown in FIG. 3 uses a four-coupling-slot arrangement for the first two full cavities, AC2 and AC3, and a type-T two-coupling-slot configuration for the remaining accelerator cavities, AC4–AC11. Cavities AC2 and AC3 introduce no quadrupole component and accelerate the electron beam to be highly relativistic so that the type T-coupling then introduces only a very small net quadrupole focusing.

The four-coupling-slot arrangement cannot be carried throughout the accelerator. At high average currents, beam breakup will occur because of the coupling of a dipole mode from cell-to-cell. In the type-T coupling-cell configuration, the dipole mode does not couple because the coupling slots are rotated 90° across the coupling cavity. In the four-slot coupling-cells, the slots are rotated 45° across the coupling cavity and very effectively couple the dipole modes. In one embodiment, a four-slot coupling is provided with each slot encompassing an angle of about 35° and a two-slot coupling is provided with each slot encompassing an angle of about 50°.

In a preferred embodiment of the present invention, the first cavity, half cavity type A, is longer than one-half of a standard $\pi/2$ cavity. For example, a standard 1300 Mhz half-cavity is 5.77 cm long and a type A half-cavity is 9 mm, or about 15%, longer. The longer cell has two advantages. First, the exit phase of the electron bunch depends on the cell length. With a single rf feed, the proper energy phase to minimize energy spread is met by adjusting the first cavity length. Second, a longer first cavity increases the electron-beam energy at the exit of the first cavity to reduce the space-charge effects and improve the final emittance. For example, with the longer first cavity discussed above, the exit energy from the first cell is 1.5 MeV instead of 1.0 MeV for a regular half-cell.

The tuning of half cavity type A affects multipactoring within coupling cell cavities along accelerator 10. Multipactoring occurs in a coupling cavity when a coupling cavity is resonant at the beam frequency and there is sufficient power to accelerate electrons the length of the coupling cavity in one-half of an rf period. Multipactoring is a known effect and it can produce undesirable beam perturbations. One solution is to tune the accelerating cavities to increase the power level in the coupling cavities above a power level at which multipactoring cannot occur.

In a preferred embodiment, solenoids 42 and 46 (FIG. 1) are used to reduce emittance growth caused by space charge. This is a known technique wherein the radial expansion of the electron bunch emitted from photocathode 18 is compensated by using the axial field from the solenoid to focus the emitted electron bunch at an axial location where sufficient beam energy exists to minimize emittance effects from space charge considerations. In one aspect of the present design, solenoids 42 and 46 are enclosed in ferromagnetic housings 44 and 48, respectively, to better concentrate the field along the beam axis 16.

Figure 4:
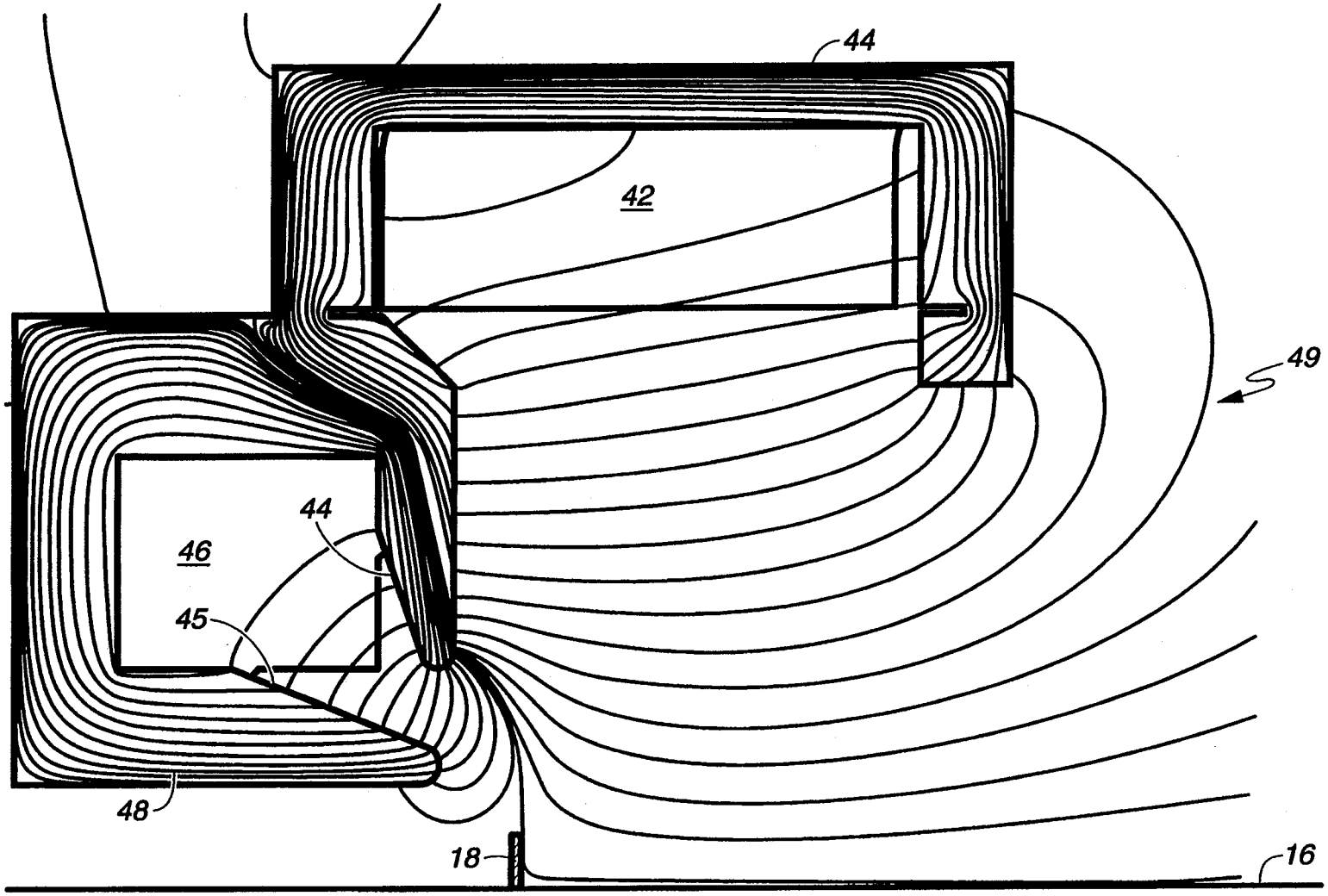
FIG. 4 graphically depicts the magnetic field lines adjacent the photocathode in one embodiment of an accelerator.

One feature of the present invention is depicted in FIG. 4. Bucking solenoid 46 is surrounded by ferromagnetic housing 48 having a configuration selected to minimize the emittance of electrons produced from photocathode 18. More particularly, housing 48 produces a magnetic field 49 shape that provides a generally uniform longitudinal magnetic field over the surface of photocathode 18 with a value less than one gauss. Faces 44 and 45 are each a portion of a cone defined by an included angle selected to produce the magnetic field lines 49 exemplified in FIG. 4. The above components and fields are symmetrical about beam axis 16 (see also FIG. 1).

In one embodiment, housing 44 and 48 are a magnetic iron, SAE 1006 steel. Each one of faces 44 and 45 of housing 48 are defined by an included angle of 143.58°. A conventional magnetic design code, POISSON, was used to generate a map of magnetic field 49 to define the field over photocathode 18. Table A shows the very low longitudinal fields available from the design. By way of comparison, the radial field strengths are also provided.

TABLE A

PHOTOCATHODE MAGNETIC FIELD STRENGTH (B in Gauss)

| r | $B_z$ | $B_r$ |
|---|---|---|
| 0.0 | −0.038 | 0.000 |
| 0.1 | −0.176 | 23.365 |
| 0.2 | −0.077 | 46.783 |
| 0.3 | 0.126 | 70.402 |
| 0.4 | 0.340 | 94.165 |
| 0.5 | 0.692 | 118.165 |

Thus, a high peak radial field strength can be maintained near the cathode while allowing the longitudinal field to be less than one gauss.

Figure 5:
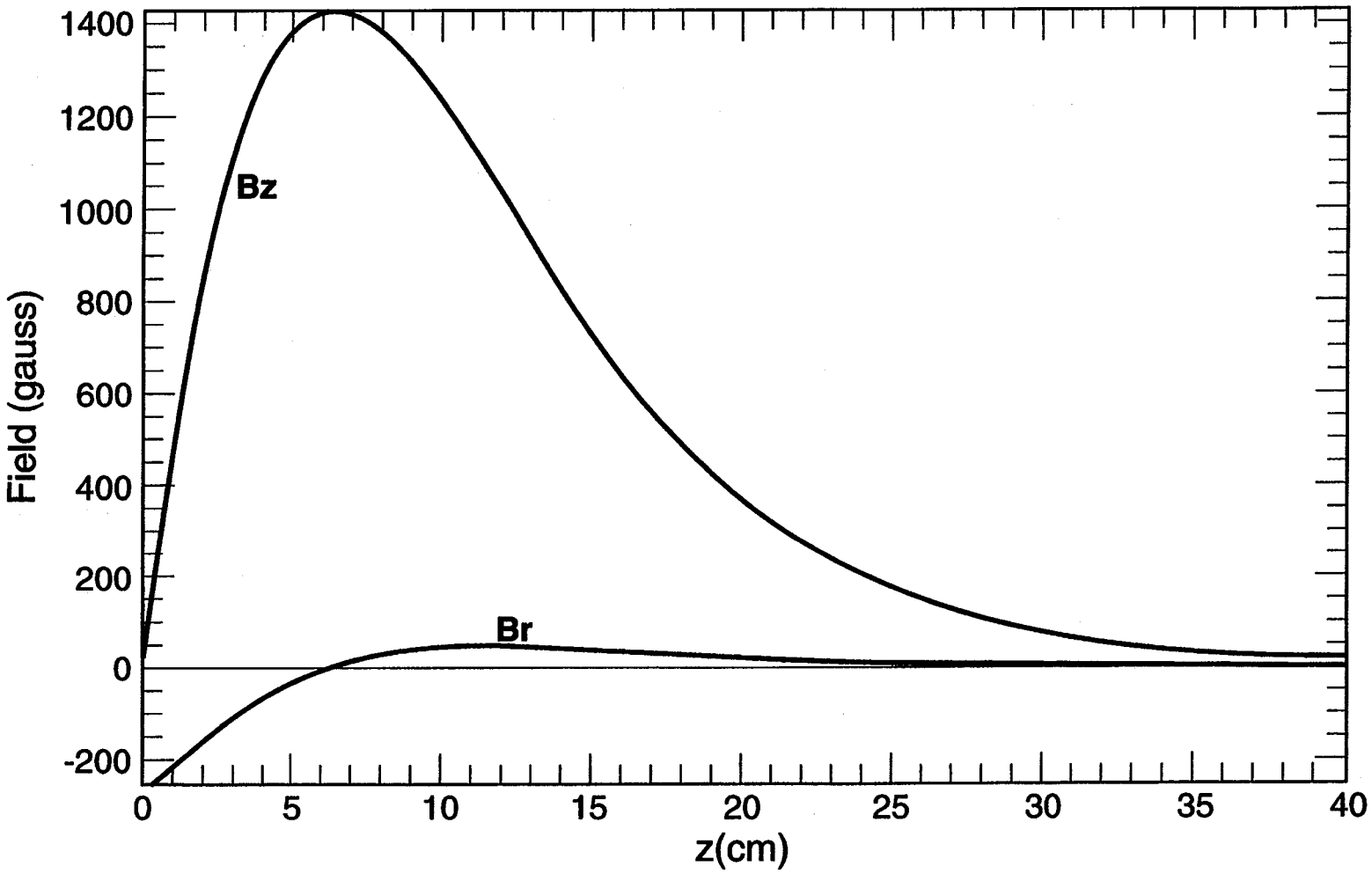
FIG. 5 graphically depicts the magnetic field strength along the axis of a first few accelerating cavities.

The composite longitudinal and radial magnetic fields obtained from combined solenoid 42 and bucking 46 coils of one exemplary design are illustrated in FIG. 5. The longitudinal component $B_z$ starts near zero at the cathode, increases to a high focusing field a short distance from photocathode 18 (e.g., 1400 G at 6 cm) to provide low emittance of the electrons from photocathode 18, peaks, and returns to a low value within the first plurality of cells 22, 24 (FIG. 1). The radial field component $B_r$ returns to a low value within the first half cell 22. The net effect is a focusing solenoid field that occurs within a short distance along axis 16 so that a high field gradient is maintained within accelerating cavities 24, 26. It will be appreciated that the emittance obtained from an accelerator design using a shaped field from a bucking solenoid 46 is improved by a factor of two over the emittance obtained from using only a conventional focusing solenoid 42.

Design simulations of an electron beam accelerator having the various exemplary characteristics taught herein were done using the PARMELA design code. For these simulations, the emittance figure of merits was the 90% normalized emittance, $\epsilon_n$, equivalent to four times the rms value. Also, the "slice" emittance was calculated by dividing a micropulse into slices in time equal to a slippage length, with the smallest time slice limited to 1% of the total pulse length. In the present design, temporal mixing of the electrons does not occur. The simulations were based on the following features: 20-MeV output energy, average cavity gradients of 22 MeV/m, and 8- to 20-ps long micropulses. The simulations are compatible with an accelerator operating up to a 1% duty cycle and with cryogenic operation. The accelerator operates with a 1300-MHz, 20 MW-peak-power klystron. The simulation results show, at 2.3 nC, a peak current of 180 A and a 90% slice emittance of 6.4 $\pi$·mm·mrad, and at 4.6 nC, a peak current of 300 A and a 90% slice emittance of 9.4 $\pi$·mm·mrad. In both cases, the beam emittance was less than the design goal of 10 $\pi$·mm·mrad.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A linear accelerator, using an exciting energy at an rf frequency to produce an alternating magnetic field for accelerating along an axial beam direction electrons emitted from a photocathode source, comprising:

a first plurality of accelerating cavities aligned along said axial beam direction and serially connected for accelerating said electrons from said source to a relativistic velocity, each one of said first plurality of cavities having end walls with four coupling slots aligned for passing said alternating magnetic field therethrough, wherein none of said four coupling slots introduce a quadrupole lens effect on said electrons; and a second plurality of accelerating cavities serially connected for receiving said electrons at said relativistic velocity from said first plurality of accelerating cavities, each one of said second plurality of cavities having end walls with two coupling slots, wherein said coupling slots are in a type-T configuration to define two quadrupole lens with a net quadrupole effect approaching zero;

wherein said exciting energy operatively connects said first and second plurality of accelerating cavities for accelerating said electrons.

2. A linear accelerator according to claim 1, further including solenoid means disposed adjacent said photocathode for producing a substantially uniform solenoidal magnetic field with a value less than one gauss in a direction perpendicular to said axial beam direction and increasing to a relatively high value within a short distance along said axial beam direction from said photocathode source for minimizing a normalized transverse emittance of electrons emitted from said photocathode source.

3. A linear accelerator according to claim 1, wherein each one of said end walls with said four slots has an orientation rotated 45° relative to an abutting one of said end walls with four slots.

4. A linear accelerator according to claim 1, wherein said first plurality of accelerating cavities comprises a first cavity with a single end wall facing said photocathode source and second and third cavities, each one of said first, second, and third cavities having two end walls facing a respective interior portion of said first, second, and third cavities, where said first, second and third cavities are serially connected and aligned for accelerating said electrons.

5. A linear accelerator according to claim 4, wherein said first cavity has a length greater than one-half the wavelength of said rf frequency effective to phase match said electron beam with said rf frequency along said first and second plurality of cavities.

6. A linear accelerator according to claim 4, wherein each one of said end walls with said four slots has an orientation rotated 45° relative to an abutting one of said end walls with four slots.

7. A linear accelerator according to claim 1, further including solenoid means disposed adjacent said photocathode for producing a substantially uniform solenoidal magnetic field with a value less than one gauss in a direction perpendicular to said axial beam direction and increasing to a relatively high value within a short distance along said axial beam direction from said photocathode source for minimizing a normalized transverse emittance of electrons emitted from said photocathode source.

* * * * *